United States Patent [19]

Kovachevich

[11] 3,978,608

[45] Sept. 7, 1976

[54] METHOD OF EFFECTING A CONTINUOUS MOVEMENT OF A FIBROUS MATERIAL

[76] Inventor: Thomas Kovachevich, 4845 S. Kenwood Ave., Chicago, Ill. 60615

[22] Filed: Aug. 20, 1975

[21] Appl. No.: 606,069

[52] U.S. Cl. ..... 46/1 R; 40/106.22; 40/106.25; 46/41; 272/8 R

[51] Int. Cl.[2] ..... A63H 33/00

[58] Field of Search ..... 46/124, 57, 157, 152, 46/41, 44, 1 R; 40/37, 37.1, 40, 106.22, 106.25, 106.41, 128, 218, 326; 272/8 R, 8 N, 27 R, 27 N

[56] References Cited

UNITED STATES PATENTS

| | | | |
|---|---|---|---|
| 589,173 | 8/1897 | Henke | 46/57 X |
| 1,282,212 | 10/1918 | Fulton | 40/37 X |
| 2,726,320 | 12/1955 | Damiano | 40/40 X |
| 2,760,302 | 8/1956 | Cheskin | 46/157 UX |
| 2,952,462 | 9/1960 | Planin | 46/152 X |
| 3,811,990 | 5/1974 | Stoff | 46/41 |

*Primary Examiner*—F. Barry Shay
*Attorney, Agent, or Firm*—Dominik, Knechtel, Godula & Demeur

[57] ABSTRACT

There is disclosed a method for effecting the continuous movement of a fibrous flexible sheet material body which includes the steps of providing an environment which includes a liquid capable of vaporization, providing a membrane permeable to the liquid and positioned relative to the liquid such that vapors emanating from the liquid make contact with and permeate the membrane, and providing a fibrous flexible sheet material body freely positioned on the surface of the membrane and above the liquid such that vapors caused by vaporization of the liquid pass through the permeable membrane and coact with the fibrous material to cause a twisting and moving motion of the body which remains continuous with the provision of vapors permeating through the membrane. There is also disclosed a game device embodying the subject method disclosed herein.

12 Claims, 4 Drawing Figures

METHOD OF EFFECTING A CONTINUOUS MOVEMENT OF A FIBROUS MATERIAL

BACKGROUND OF THE INVENTION

Various types of novelty items have been developed, generally with a view towards providing toys or game devices. In this connection, one is quite familiar with viewers which display prism patterns, optical-illusion type devices and the like. Generally, such devices employ various forces of nature as the same interact and coact with given material to produce an illusory effect. In most instances, such devices or games have had little application beyond that of either games or toys.

The present invention concerns itself with the employment of a method for causing the continuous twisting, turning, and actual motion of a fibrous material when freely positioned atop a permeable membrane which is provided with a source of gas vapors to contact and permeate through the membrane and coact with the fibrous material. It has been determined after extensive testing that the principals employed and involved in connection with the method of the present invention relate to the physical characteristics of the material and the development of a new result achieved thereby. In addition, it is contemplated that the method of the present invention has applications which are far broader than that of toys or games in that it is contemplated that the method could potentially result in far reaching developments having a beneficial impact upon various aspects of transportation, construction, as well as energy production.

It is further to be noted that the method as will be described hereinafter involves the application of physical principles as the same relate to interaction with particular types of material to cause motion of a fibrous material, and that the result achieved thereby is clearly not of an illusory nature. In point of fact, the motion which is achieved is actually occurring and will continue to occur on a continuous basis concomitant with the provision of vapors through the permeable membrane. Within the framework of the present invention, it is intended that the method as described herein has immediate application as a toy or a game device from the standpoint of providing a device which has a fascination level to it and hence, has a commercial application in that sense initially. However, as has been indicated above, other far reaching applications of the method are clearly contemplated by the present invention and such further applications will become more clear upon a more definitive explanation of the invention herein.

BRIEF SUMMARY OF INVENTION

The present invention consists of the method for effecting the continuous movement of a fibrous material which includes the steps of providing an environment which provides a source of gaseous vapors, providing a membrane permeable to the vapors and positioned relative to the vapors such that the vapors emanating from the source thereof make contact with and permeate the membrane, and providing a fibrous material freely positioned on the surface of the permeable membrane and above the source of vapors whereby vapors emanating from the source pass through the permeable membrane and coact with the fibrous material thereby causing a twisting movement of the fibrous material which is continuous with the provision of vapors through the membrane. In the simplest form of the invention, the source of gaseous vapors is from a container containing a quantity of a liquid such as water or the like, to which heat may be applied in order to cause a more efficient vaporization of the water. The fibrous material is positioned atop a permeable membrane which is in turn positioned above the liquid water, and as the vapors permeate the permeable membrane and contact the fibrous material, a twisting, curling, turning, motion is imparted to the fibrous material. This motion will continue so long as vapors are available from the source to permeate the membrane and make contact with the fibrous material.

The above recited method of the present invention has application in connection with an article of manufacture which is in the nature of a toy device, and provides a container into which a liquid may be deposited, the container in turn accommodated within a housing bounded by a bottom wall, side walls, and a top wall, the top wall forming the permeable membrane, and a plurality of fibrous material elements which may be freely positioned atop the permeable membrane. The toy device is operated by filling the container with a liquid such as hot water, and sliding the container under the permeable membrane and then freely positioning one of the fibrous material elements atop the membrane and to thereafter observe the movement of the fibrous material as the same coacts with the water vapors permeating the membrane.

It will be appreciated from the above description that any such toy device which embodies the subject method may take any one of a variety of forms and it is not intended to be limited to a particular toy embodiment by virtue of the description set forth hereinafter. Furthermore, as previously indicated, the method of the present invention has application over and above the provision of a toy device and it is believed that such further applications will be more clearly defined following the description set forth hereinbelow.

OBJECTS AND ADVANTAGES

It is therefore the principal object of the invention to provide a method for effecting the continuous movement of a fibrous material which includes the steps of providing an environment which provides a source of gaseous vapors, providing a membrane permeable to the vapors and positioned relative to the vapors such that vapors emanating from the source thereof contact and permeate the membrane, and providing a fibrous material freely positioned on the surface of the membrane and above the source of vapors such that vapors emanating from the source thereof pass through the membrane and coact with the fibrous material thereby to cause a twisting and turning movement of the fibrous material which is continuous with the provision of vapors through the membrane.

In connection with the foregoing object, it is a further object of the invention to provide a method as described above wherein the source of gaseous vapors is a liquid deposited in a container over which the permeable membrane rests.

A further object of this invention is to provide a method of the type described above wherein heat is further applied to the liquid in order to facilitate the vaporization of the liquid and to cause vapors to emanate therefrom to pass through the membrane and coact with the fibrous materials positioned atop the membrane to cause the twisting and turning movement thereof.

Another object of the invention is to employ the method described above in connection with a fascination type game or toy, the toy consisting of a housing containing a platform forming a permeable membrane, a container into which a liquid may be deposited below the membrane, and the provision of at least one fibrous material element for positioning atop the membrane such that water positioned within the container will eliminate vapors through the permeable membrane to cause the twisting and turning movement of the fibrous material element positioned there atop.

Further objects of the invention pertain to the application of the subject method to a wide variety of fields of endeavor, including recreational applications, transportational applications, energy production systems, and the like.

Further features of the invention pertain to the particular steps of the method and arrangement of the parts whereby the above outlined and additional operating features thereof are attained.

The invention, both as to its organization and method of operation, together with further objects and advantages thereof, will best be understood by reference to the following specification, taken in connection with the accompanying drawings in which.

Figure 3:
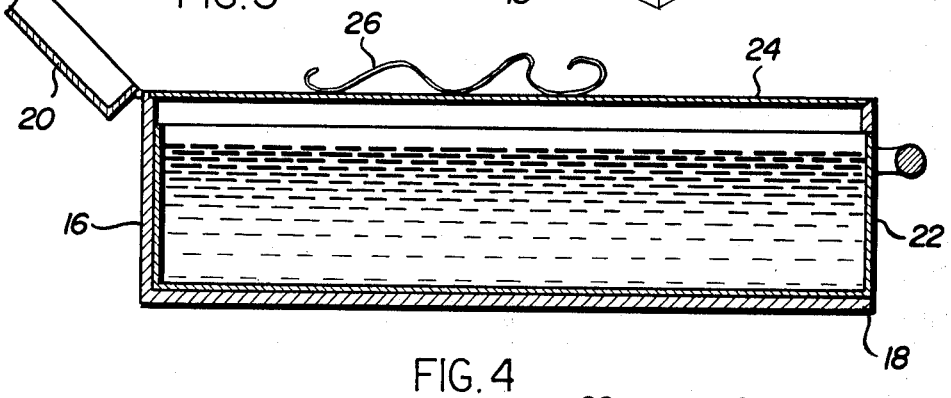
Figure 4:
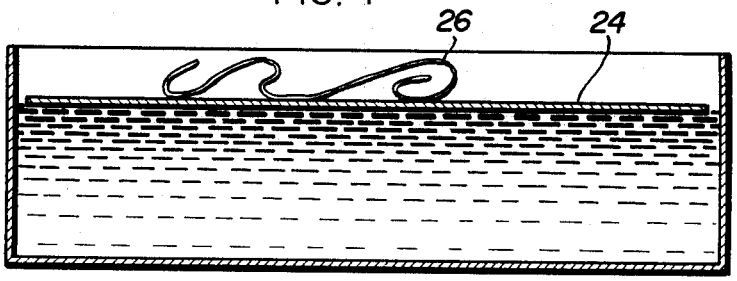

FIG. 3 is a side elevational view, in cross section, showing the toy device with a fibrous material element positioned atop the permeable membrane and the container having a quantity of liquid positioned therein in the operational position; and FIG. 4 is a side elevational view, in cross section, wherein the permeable membrane is shown to be positioned directly atop the water level as opposed to the view shown in FIG. 3 wherein the permeable membrane is positioned at a point above the water level.

DETAILED DESCRIPTION OF INVENTION

It has been found that the method of the present invention operates, generally, where one provides a liquid capable of vaporization, a permeable membrane positioned generally above the liquid such that the vapors emanating therefrom may pass through and permeate the membrane, and by placing an element of fibrous material atop the membrane which may be contacted by the vapors to cause the twisting and turning movement. The movement which has generally been defined as a twisting and turning movement herein, may be more fully defined as a movement which causes the fibrous material to twist, turn, roll over upon itself, and generally move along the surface of the membrane. It has further been found that the movement will continue so long as the vapors are continuously supplied through the membrane to contact the fibrous material thereby to cause the movement. The precise physical forces causing the movement in the fibrous material are not completely understood although it is believed that the movement is the result of the expansion and contraction of the fibers forming the fibrous material, or alternatively, perhaps an ionic or ionization process. In any event, it has been found that a number of different types of fibrous material may be utilized in the subject invention, and furthermore, a number of different types of membranes may be employed. It has further been found that as to the liquids to be employed as the source of gaseous vapors, a number of such liquids may similarly be employed.

It has been found emperically that liquids such as water, weak acids, weak alkalis, oils, including the mineral and petroleum, alcohol and acetone will all function in the manner detailed herein. In short, so long as the liquid is capable of vaporization and the permeable membrane permits the vapors emanating from the liquid to pass therethrough, a twisting and continuous movement of the fibrous material is observed. Furthermore, it has been observed that where heat is applied to the liquid thereby to facilitate the vaporization process, the movement of the fibrous material is accelerated. However, it has further been observed that where the liquids are cold, movement of the fibrous material is still observed although the movement is at a much slower rate. Hence, it may be said that temperature is directly related to the speed of movement of the fibrous material.

As to the permeable membrane, it has been found that the membranes may be successfully employed which range from paper, to metal screening. For example, membranes formed of paper, cardboard, synthetic mesh plastics, natural cloth, or metal screening, will successfully operate within the purview of the method of the present invention and it is believed that such membranes will function successfully so long as the vapors which are generated may permeate and pass through the membrane.

In terms of the fibrous materials which are employed on top of the membrane and which exhibit the twisting, turning, and curling motion, it has been found, emperically, that fibrous materials such as paper and paper-like fibers will operate successfully. The principle object of the invention is to obtain not only a twisting and curling motion, but a true movement of the materials such that it will move across the membrane by means of a curling, twisting, and waving motion. It has been found that virtually all paper and paper-like fibrous materials will have some degree of curling or waving motion when exposed to a system of the type described herein. However, not all fibrous materials will have a continuous movement and motion under identical conditions. It has been found, for example, that heavier paper requires higher temperatures to work properly. Papers such as thin tracing paper will operate far more efficiently and will even operate efficiently under very cold temperatures where the amount of vaporization is minimal.

The very finely ground wood pulp paper such as newsprint will only exhibit curling or waving motion but does not exhibit true or real movement or motion on a continuous basis with the provision of gaseous vapors. If, however, these finely ground wood pulp papers are heated with acid during the production processes when they are manufactured, they will operate quite well within the framework of the present invention. An example of this type of paper is tracing paper which, during the manufacturing process, is cooked in sulfuric acid. Also, the longer fiber papers operate quite well in the subject process, and these papers would include wood pulp paper of the type produced by Thilmany Paper Company.

As a matter of general principles, it has been found that all acid-treated wood pulp fibrous materials, all acid-treated pulps, all alkali-treated pulps, mixtures of acid and alkali-treated pulps, mixtures of acid-treated pulp with mechanically-type ground pulps having greater than 15% of the acid-treated portion, and mixtures of alkali-treated pulps with mechanically ground pulp having greater than 15% of the alkali-treated portion will operate within the subject method. These would include parchments, bonds, tracing paper and the like. Longer fiber wood pulp papers will operate quite well. Also, papers which are treated or coated or laminated with synthetic materials or organic compounds will operate. For example, coatings such as polyethlene, latex, wax, vinylidene chloride, will all function accordingly. However, if the lamination is so heavy that it changes the nature of the fibrous material into a non-fibrous material surface, then such papers will not operate properly. It has also been found that non-wood pulp materials such as 100% cotton parchment paper will operate, and it is believed that this is the result of the acid treatment which occurs with such types of papers in the manufacturing process. Other acid treated materials will also operate so long as they are "paper-like." Very thick fibrous materials are difficult to use and do not operate as well within the framework of the method of the present invention.

Insofar as the motion which is achieved by the fibrous material is concerned, it has been found that the shape and direction of the fibrous material element has an impact on the type of movement and motion. In addition, it has been found that solid shapes will also exhibit the twisting and curling and waving movement, and hence, such shapes as cylinders, cones, and the like will roll, turn, and move.

As was indicated previously, it is contemplated that the most practical application of the method of the present invention is the provision of a fascination-type toy. In this connection, the drawings illustrate a typical type of toy device that can be easily manufactured which will provide visual entertainment for a child or an adult observing the movement of the fibrous material. However, as was indicated previously, it is contemplated that a number of other applications can be envisioned for the method set forth herein and these will be discussed more fully hereinafter.

With respect to FIGS. 1 through 4 of the drawings, there is shown a toy device generally referred to by the numeral 10 which is formed by a housing 12 composed of side walls 14, a rear wall 16, and a bottom wall 18. A top lid 20 is provided which is pivotally hinged to the rear wall 16. It will further be noted that the front portion of the housing 12 is essentially open to accommodate a drawer 22 therein. The drawer 22 is actually a container, as is more clearly shown in FIGS. 3 and 4 of the drawings, the drawer being slideably moveable within the housing 12. The top wall of the housing 12 is formed by a permeable membrane 24 which is exposed to the operator's view when the top lid 20 is pivotally open. The drawer 22 functions as a container for a liquid such as water or the like, as illustrated in FIGS. 3 and 4 of the drawings.

Figure 1:
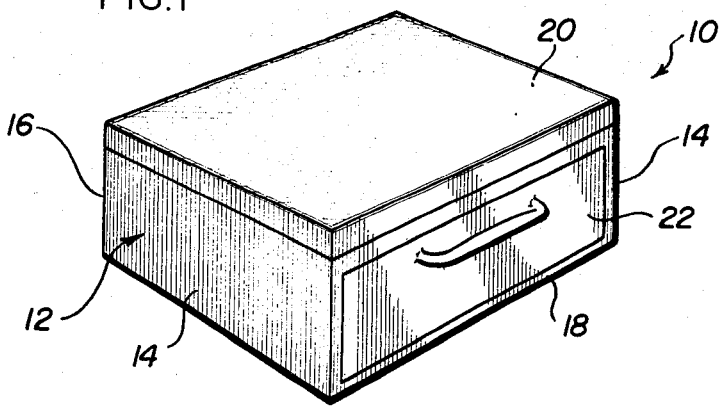
FIG. 1 is a perspective view of one embodiment of a toy game contemplated by the present invention which employs the method as described herein.
Figure 2:
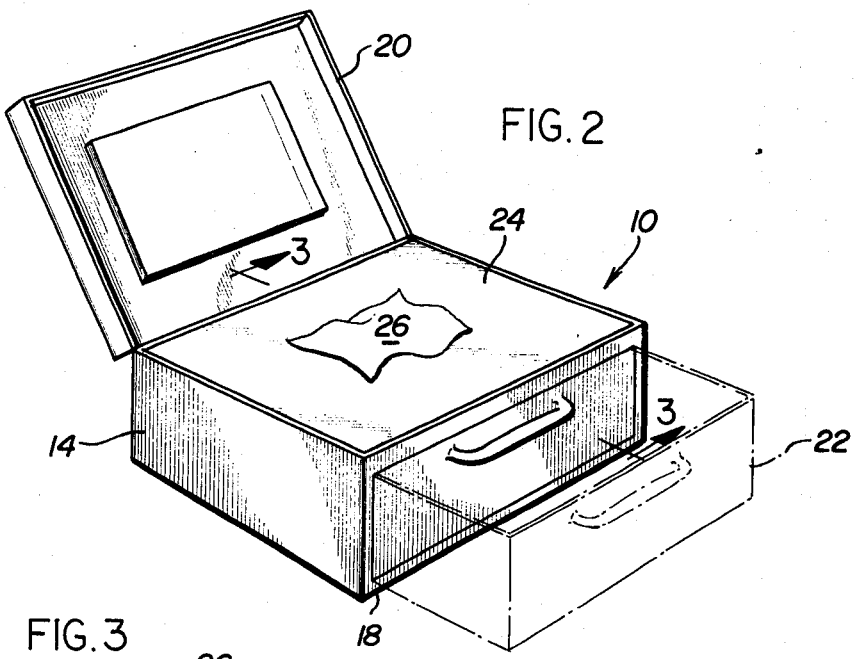
FIG. 2 is a perspective view of the toy device showing the case in the open position with the permeable membrane exposed and showing the container in which a liquid is placed in the closed position in solid lines and in the open position in phantom lines.

It will be appreciated that in the embodiment shown in FIGS. 1 through 3 of the drawings, the permeable membrane 24 forms a part of the housing 12 and when the drawer 22 is removed and filled with a liquid such as water, and then reinserted into the housing 12, the permeable membrane 24 will be positioned above the level of the liquid water. In FIG. 4 of the drawings, it will be observed that an alternate embodiment contemplates that the permeable membrane 24 may be positioned directly on the surface of the water and the method of the present invention will continue to perform successfully.

As illustrated in FIGS. 2 through 4 of the drawings, a fibrous material element 26 is freely positioned atop the permeable membrane 24 such that when the drawer 22 with liquid contained therein is reinserted into the housing 12, and vaporization occurs, the gas vapors may then permeate the permeable membrane 24 and will cause a twisting, curling, moving motion of the fibrous material element 26 thereon.

It will be appreciated that the toy device as illustrated in FIGS. 1 through 4 of the drawings presents a fascination-type device for children or adults and hence, the method of the present invention may take a commercial form in this sense. It will also be appreciated that a number of different shapes of fibrous material elements 26 may be employed and in this connection, it is contemplated that forms such as animals, geometrical shapes, and the like may be fashioned to provide a greater level of fascination. In addition, it is contemplated that the toy device 10 may be employed as a packaging device wherein any packaging having a depth dimension and capable of holding a liquid may be designed such that after the package has been utilized for purposes of containing the object to be vended to the public, the spent package may then be utilized in connection with the practice of the present invention. For example, it is contemplated that boxes currently used in connection with fast food service businesses may be adapted to the practice of the present invention such that children purchasing food from such establishments may subsequently use the box-type packages to perform a game of the type described. In this application, it is anticipated that the vendor could provide any type of paper-like permeable membrane with the packet, and perhaps a series of two or more animal cutouts formed of tracing paper or the like such that when the food is delivered to the purchaser in the box, the box may then be re-used as a toy device of the type described herein.

Quite obviously, the specific embodiment of the toy may take any shape or form, the only requirement being that the housing have a depth dimension in order to accommodate a body of liquid such as water and permit the positioning of a permeable membrane above or on the surface of the liquid.

In order to more fully enlarge the scope of the invention, the following examples are set forth thereby to show the perimeter of the various types of fibrous material elements which may be employed, the types of permeable membranes which may be employed, as well as the different types of liquids which may be utilized. It should be indicated that the following examples are merely illustrative of the perimeter of the present invention and should not be taken to indicate the precise scope of the invention in terms of the materials which may be utilized and hence, to this extent, the following examples are not intended to limit the subject invention.

EXAMPLE I

A representative container having dimensions of 24 inches long, 18 inches wide, and 4 inches deep is provided with 1 liter of water. The water is pre-heated to 90° F and then placed in the container. A sheet of 9 by 12 inch 25 lb. tracing paper of a natural wood-pulp type is employed as the semi-permeable membrane. The particular wood-pulp paper has a thickness of 0.002 inches. The semi-permeable membrane is positioned to float on the surface of the water. A small piece of the same type of paper is cut into a rectangular shape 2 inches by 2½ inches. The smaller piece of tracing paper is placed on top of the floating 9 by 12 inch tracing paper forming the semi-permeable membrane and within 5 seconds from freely positioning the same on the permeable membrane, the rectangular piece of tracing paper commences a twisting and bending motion, turning over upon itself, standing on end, and generally travelling along the surface of the 9 by 12 inch semi-permeable membrane. The motion remains continuous for a period of 2 hours, the motion ceasing only when the semi-permeable membrane has become fully wetted, or alternatively, when the water supplying the water vapor has fully evaporated.

EXAMPLE II

The same conditions as employed in connection with Example I are employed in Example II with the exception that the water temperature is raised to 110°F, and the semi-permeable membrane is a 3 by 3 foot sheet of tracing paper which is positioned above the surface of the water and not in contact with the water. Once again, a sheet of tracing paper 2 by 2½ inches is placed atop the semi-permeable membrane and a twisting, curling, end-over-end movement of the fibrous material element is observed as the same travels across the surface of the larger sheet of tracing paper forming the semi-permeable membrane much in the same nature as identified in Example I above.

EXAMPLE III

The same perimeter employed in connection with Example I above are again employed in connection with Example III with the exception that the fibrous material element is formed by a sheet of 2 by 2½ inch rectangular paper made of 100% cotton fiber, 20 lb. parchment paper with no finish. The water temperature is 110° at the beginning of the experiment. The semi-permeable membrane is similarly formed of 100% cotton fiber, 20 lb. parchment paper having a dimension of 9 by 12 inches. In this particular example, once again, the semi-permeable membrane is positioned on the surface of the water thereby to float on the surface.

Once again, a twisting, curling, end-over-end, bending motion of the fibrous material element is observed and the same moves across the surface of the semi-permeable membrane.

EXAMPLE IV

The same perimeter and conditions as set forth in connection with Example III above are employed, excepting that the fibrous material element is formed by a rectangular sheet of paper 2 by 2½ inches in dimensions and is a wood-pulp, 25% cotton fiber, 13 lb. parchment paper with a cockle finish.

Once again, the fibrous material element is observed to exhibit a twisting, turning, end-over-end, curling motion as the same moves across the surface of the semi-permeable membrane.

EXAMPLE V

The same perimeter and conditions as set forth in connection with Example III above are employed in Example V with the exception that the fibrous material element is a sheet of rectangular paper, 2 by 2½ inches in dimension, and is formed by a wood-pulp, 75% cotton fiber, 16 lb. paper with no finish.

Once again, the same type of motion is observed with respect to the fibrous material element and the same does move across the surface of the semi-permeable membrane.

EXAMPLE VI

The same perimeter and conditions as set forth in connection with Example III are once again employed with the exception that the fibrous material element is formed by a rectangular piece of paper 2 by 2½ inches in dimensions and is formed by a 75% cotton fiber 9 lb. onion skin paper with a cockle finish.

The same type of motion is exhibited by the fibrous material as the same moves across the surface of the semi-permeable membrane.

EXAMPLE VII

The same perimeter and conditions as set forth in connection with Example II above, are again employed in Example VII with the exception that the semi-permeable membrane is formed of a nylon-commercial type cloth placed across the surface of the pan such that the semi-permeable membrane is out of contact with the water. The fibrous material element is the same as set forth in connection with Example I, that being a natural wood-pulp type tracing paper, 25 lb., and 2 and 2½ inches in dimensions.

The same type of movement of the fibrous material is observed with regard to the material employed in Example VII.

EXAMPLE VIII

The same perimeter and conditions as set forth in connection with Example VII above are reemployed, excepting that the fibrous material element is a rectangular paper 2 by 2½ inches in dimensions, made of 100% cotton fiber, 20 lb. parchment paper of the type described in connection with Example III.

It is observed that this type of fibrous material will exhibit the twisting, curling, end-over-end movement, the nylon providing a suitable semi-permeable membrane.

The procedure outlined in connection with Example VIII above, is repeated utilizing the nylon cloth as a semi-permeable membrane, and in each case, employing the type of fibrous material as identified in Examples IV, V, and VI above, in each case, the fibrous material element exhibits the same type of twisting, curling, end-over-end, contraction and expansion-type motion as identified hereinabove.

EXAMPLE IX

The same conditions are perimeter as set forth in connection with Example II are re-employed except the semi-permeable membrane is formed of a metal screen, fine mesh, which is placed above the level of the water. The fibrous material element is a rectangular piece of paper 2 by 2½ inches in dimension, formed of a natural wood-pulp type tracing paper.

Once again, the same type of twisting, curling, end-over-end motion is exhibited by the fibrous material. It is therefore apparent that a metal screen of fine mesh will operate efficiently within the framework of the method of the present invention since the water vapors emanating from the pan or container are permitted to permeate through this screen and thereby contact the fibrous material causing the same to move as indicated herein.

EXAMPLE X

The conditions and perimeter as identified in connection with Examples I and II above are employed, with the exception that the fibrous material moving element is formed of United States currency, one dollar bill, placed atop the permeable membrane. It is observed that the same type of twisting, curling, end-over-end movement of the currency is exhibited at the same moves across the surface of the semi-permeable membrane.

EXAMPLE XI

In this particular example, a steam vaporizor is employed which contains a quantity of water, and is of the type which generates steam or water vapor. The vaporizor is positioned below a semi-permeable membrane which is formed of a fine mesh metal screen. The fibrous material element is a 2 by 2½ inch rectangular piece of tracing paper of the type identified in Example I above, and the same is placed atop a semi-permeable membrane. The vaporizor is then activated such that steam or water vapor is directed by the nozzle of the vaporizor upwardly to contact and permeate the semi-permeable, metal screen positioned there atop.

A twisting, curling, end-over-end movement of the tracing paper is observed along the surface of the semi-permeable membrane such that the tracing paper will move across the surface thereof.

The conditions as set forth in connection with Examples I through XI above, may be repeated by substituting methanol and ethanol as the liquid as contrasted with water. In each case, the same type of twisting, curling, end-over-end, travelling motion of the fibrous material across the surface of the semi-permeable membrane is observed, other fluids which have been observed to function in connection with the method of the present invention include weak acids, weak alkalis, oils, such as mineral and petro oil as well as acetone. Furthermore, it is observed that when the liquids are in the heated condition at the commencement of the experiment, such that a greater degree of vaporization is achieved, the motion exhibited by the fibrous material element is more accelerated than when the liquids are in a colder state. However, so long as a sufficient degree of vaporization is occurring, the method of the present invention will operate to cause a movement of the tracing paper even though the liquids may be in a cold or colder condition. Generally, where the liquids are cold or in a colder condition, such that the degree of vaporization is less, this will reflect itself in a slower movement of the fibrous material when positioned on the surface of the semi-permeable membrane. Hence, it is observed that the degree of movement of the fibrous material is somewhat dependent upon the degree of vaporization of the liquid and therefore upon the temperature of the liquid.

The above-indicated examples may similarly be conducted by using any number of types of paper for the fibrous material, and these would include longer fiber paper such as Kraft-type wood-pulp papers, with and without finishes, coated types including polyethlene, wax, and vinylidene chloride, and latex-type coatings, acid-treated wood-pulp papers, such as parchments, bond-type papers, onion skin type papers, 100% cotton fiber papers, mixtures of cotton and wood-pulp papers, hard wood pulp and soft wood pulp papers, mold-proof treated papers, asphalt laminated-thin coat papers, and the like.

It has also been found that the examples may be repeated with similar success where the semi-permeable membranes may be metal screens, formed of aluminum, copper, generally fine mesh, although course mesh such as window screens will similarly operate, cloth such as natural wool and/or cotton, as well as synthetics such as nylon, orlon, and dacron will similarly function. In addition, synthetics such as synthetic sponge material will operate, so long as the thickness is such as to permit the permeation of the gaseous vapors therethrough in order to contact the fibrous materials.

In terms of the ultimate applications of the method of the present invention, as has been indicated herein, an immediate commercialization may be envisioned in terms of a game device, which may take the form of either a game per se, or may be incorporated into a package in which other goods are shipped or vended, with the package being adapted to be reused to practice the method of the present invention. Clearly such a packaging device would have a high degree of marketing potential and illustrates a novel manner in which the method of the present invention may be employed. However, other areas of useage are clearly envisioned, and these would include potential transportion systems wherein the fibrous materials could be of an enlarged magnitude and could be formed in the shape of cylinders, or spheres could roll across the surface of a membrane provided. It is further contemplated that where the dimensions of the elements employed in connection with the practice of the present invention is sufficiently large, the movement of the fibrous material could be harnessed and could provide a source of energy for causing a resulting motion in a device in contact therewith.

It is contemplated that many other types of applications are clearly within the framework of the present invention, and it is intended that the method of the present invention will not be limited by the specific application set forth hereinabove.

It will be appreciated that the method defined herein provides means for effecting the movement of the fibrous material when positioned atop a semi-permeable membrane or any membrane permeable to a gaseous so long as the membrane is located above the source of the gaseous vapor. The semi-permeable membrane may take many forms, the only requirement being that the vapors be permitted to permeate therethrough at a reasonable rate. Similarly, the fibrous material may take the form of any number of materials so long as the materials employed are capable of inter-action with the vapors thereby to contract and expand in order to cause the necessary movement. As was indicated previously, the precise physical properties of the materials which cause the movement of the fibrous material are not completely understood, although it is believed that the expansion and contraction of the fibrous materials are the factors which cause the movement thereof. In addition, it will be appreciated that as defined herein, the method of the invention has immediate application to a gametype device of the type described herein, which may take the form of a game per se, or of packaging materials which may be adapted to a game device when their function as a packaging element has ceased.

While there has been described what is at present considered to be the preferred embodiments of the invention, it will be understood that various modifications may be made therein and it is intended to cover in the appended claims all such modifications as fall within the true spirit and scope of the invention.

What is claimed is:

1. A method for effecting the continuous movement of a fibrous material comprising the steps of providing an environment which includes a source of gaseous vapors, providing a membrane permeable to said vapors and positioned relative to said vapors such that vapors emanating from said source make contact with and permeate said membrane, and providing a body of vapor-responsive flexible sheet material freely positioned on the surface of said membrane and above said source of vapors, whereby vapors emanating from the source thereof pass through said permeable membrane and coact with said fibrous material thereby causing a twisting, curling end-over-end, horizontal movement of said fibrous material body which is continuous with the provision of vapors through said membrane.

2. The method as set forth in claim 1 above, which further includes the step of providing heat to said liquid to facilitate vaporization.

3. The method as set forth in claim 1 above, wherein said liquid is pre-heated prior to the positioning of said fibrous material body on said membrane thereby to facilitate vaporization of the liquid and the continuous movement of said fibrous material body.

4. The method as set forth in claim 1 above, wherein the liquid provided is water.

5. The method as set forth in claim 1 above, wherein said permeable membrane comprises a wood-pulp paper.

6. The method as set forth in claim 1 above, wherein said vapor-responsive material comprises wood-pulp tracing paper.

7. The method as set forth in claim 1 above, wherein said membrane is positioned directly on the surface of said liquid.

8. The method as set forth in claim 1 above, wherein said membrane is positioned above the surface of said liquid but sufficiently close to the surface of said liquid to permit vapors emanating from said liquid to contact and permeate said membrane.

9. The method as set forth in claim 1 above, wherein the upper surface of said membrane is maintained in a dry, non-wetted condition.

10. A method for effecting the continuous movement of a fibrous material comprising the steps of providing a container containing a liquid capable of vaporization, providing a membrane permeable to said liquid and positioned relative to said liquid such that vapors emanating from said liquid make contact with and permeate said membrane, and providing a body of fibrous vapor-responsive flexible sheet material freely positioned on the surface of said membrane and above said liquid, whereby vapor is caused by vaporization of said liquid which may permeate through said permeable membrane and coact with said fibrous material thereby causing a twisting, curling, end-over-end, horizontal movement of said fibrous material body which is continuous with the provision of vapors through said membrane.

11. An article of manufacture comprising, in combination, a container adapted to contain a quantity of vaporizable liquid, a permeable membrane means adapted for supporting said membrane in position immediately above said container with a major surface of said membrane generally facing said container, a quantity of a vaporizable liquid positioned within said container and immediately below said membrane, and a body of fibrous vapor-responsive flexible sheet material adapted for free positioning on the upper surface of said membrane and above said liquid, whereby vapors emanating from said liquid contact and permeate said membrane and coact with said fibrous material to cause movement of said fibrous material body which continues as long as said permeation continues to occur.

12. The article of manufacture as set forth in claim 11 above, wherein said container comprises part of a package, said container having at least side walls and a bottom wall which are impermeable to a liquid contained therein, and wherein said membrane forms a wall in said package which is adapted to overlie the top of said container, whereby the article of manufacture is formed by a container package which may be employed in the manner set forth after expended as a packaging element.

* * * * *